United States Patent [19]

Manna

[11] 4,244,525

[45] Jan. 13, 1981

[54] WRITING INSTRUMENT WITH REFILLABLE SCENT DISPENSER

[76] Inventor: Ronald A. Manna, 18 Island Hill Ave., Ridgefield, Conn. 06877

[21] Appl. No.: 93,826

[22] Filed: Nov. 13, 1979

[51] Int. Cl.[3] ..... B05B 15/00

[52] U.S. Cl. ..... 239/289; 222/192; 239/333; 401/52; 401/195

[58] Field of Search ..... 239/211, 333, 337, 349, 239/350, 289, 34, 60; 222/192, 175; 401/52, 195

[56] References Cited

U.S. PATENT DOCUMENTS

| | | | |
|---|---|---|---|
| 1,307,359 | 6/1919 | Hugetz . | |
| 1,689,569 | 10/1928 | Walerowicz . | |
| 2,011,196 | 8/1935 | Moody | 239/333 |
| 2,407,106 | 9/1946 | Shelly | 401/195 X |
| 2,452,735 | 11/1948 | Devine | 401/195 X |
| 2,865,533 | 12/1958 | Taylor | 401/52 X |
| 2,964,614 | 12/1960 | Buschle | 401/195 X |
| 3,122,328 | 2/1964 | Weber | 401/195 X |
| 3,282,253 | 11/1966 | Ryan et al. | 222/192 X |
| 3,601,315 | 8/1971 | Montalbo | 239/211 |
| 3,639,069 | 2/1972 | Gordon | 401/195 |
| 3,690,778 | 9/1972 | Hirota | 401/99 X |
| 3,888,416 | 6/1975 | Lin | 401/195 X |
| 3,963,914 | 6/1976 | Browning et al. | 401/195 X |

FOREIGN PATENT DOCUMENTS

| | | | |
|---|---|---|---|
| 1340235 | 9/1963 | France . | |
| 1488448 | 6/1967 | France | 239/333 |
| 654577 | 6/1963 | Italy | 401/195 |

*Primary Examiner*—Robert B. Reeves
*Assistant Examiner*—Michael J. Forman
*Attorney, Agent, or Firm*—Parmelee, Johnson, Bollinger & Bramblett

[57] ABSTRACT

An instrument for holding a writing implement includes an elongated housing having a recess for retaining the writing implement and a closed bottom annular chamber surrounding the recess. The annular chamber serves to hold a liquid such as a perfume or cologne. A pump including a plunger and an associated spray nozzle is mounted in the open top of the annular chamber. Reciprocating motion of the plunger varies the pressure within a pump chamber to draw liquid into the pump chamber and to expel it through the nozzle. The instrument may be used for writing or for dispensing the liquid.

12 Claims, 3 Drawing Figures

WRITING INSTRUMENT WITH REFILLABLE SCENT DISPENSER

BACKGROUND OF THE INVENTION

The present invention relates to a dual purpose instrument which can function as a writing implement, a liquid spray dispenser, or both. The disclosed implement is particularly adapted to holding and spraying a liquid perfume, cologne, room deodorant, air freshener or the like. The instrument is approximately the size of an ordinary writing pen and, as such, is convenient to carry. For example, it may be carried by a woman in a handbag like any ordinary writing implement. However, the instrument provides the user with both a writing implement and perfume dispenser, thus avoiding the necessity of separately carrying a bulky bottle of perfume or the like.

Dual purpose instruments are useful and convenient because they perform multiple functions but do not occupy much more space than similar devices performing only a single function. Examples of United States Patents illustrating dual purpose instruments are U.S. Pat. Nos. 3,963,914; 3,122,328; 2,964,614; 2,452,735; and 2,407,106 which show writing implements together with illuminating devices; U.S. Pat. Nos. 3,639,069; 2,865,533 and 1,307,359 which show writing implements having storage compartments for various materials; and U.S. Pat. No. 3,888,416 which shows a pen having a storage compartment for a solid block of scented vaporizable material.

However, an instrument which functions as a writing implement and a dispenser for a liquid has been heretofore unknown to the art. It is an object of the present invention to provide such an instrument.

SUMMARY OF THE INVENTION

The present invention provides an instrument capable of functioning as both a writing implement and a liquid dispenser for substances such as perfume, cologne, air freshener or the like.

The instrument includes an elongated housing, approximately the size of an ordinary pen, having a closed end and an open end. A portion of the closed end is recessed within the housing so that a writing implement such as a pen refill can be removably retained within the recess. An annular chamber surrounding the inner recess is defined by the inner surface of the elongated housing. One end of this annular chamber is sealed by the closed end of the elongated housing while the other end of the annular chamber is open. Liquid such as a perfume or cologne can be stored within the annular chamber.

A pump is mounted above the annular chamber in the open end thereof and a passageway is provided for connecting the annular chamber to the pump for liquid flow therebetween. When the pump is actuated, the liquid is expelled from the pump chamber through a spray nozzle. After actuation, liquid from the annular chamber is drawn into the pump chamber and the instrument is ready for another spraying cycle.

DETAILED DESCRIPTION OF THE DRAWINGS

Figure 1:
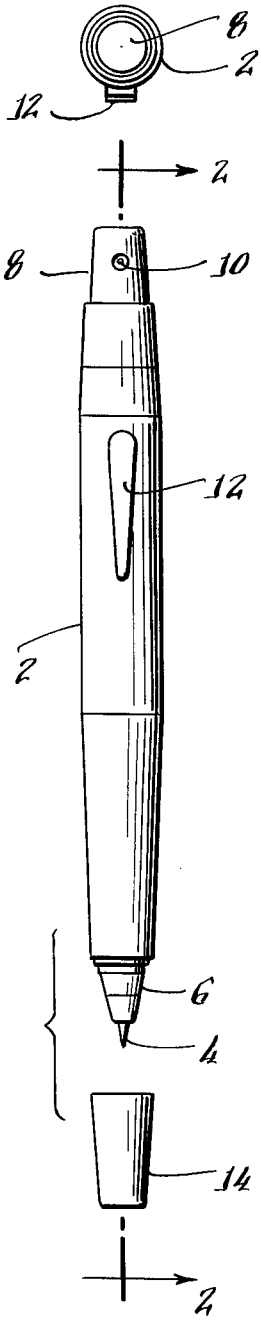
FIG. 1 is an elevational view of the new instrument with its protective cap removed.

The present invention will now be described with reference to FIGS. 1–3 of the aforementioned drawings. Referring first to FIG. 1, an elongated housing 2 is of a size and shape similar to that of an ordinary writing pen. The tip 4 of a writing implement 6 extends from one end of the housing, and a plunger 8 having a spray nozzle 10 thereon extends from the other end of the housing. A pocket clip 12 for securing the housing to the pocket of a user is fixed to the outside of the housing 2, and a cap 14 for covering the tip of the writing implement when it is not in use is shown removed from the tip.

Figure 2:
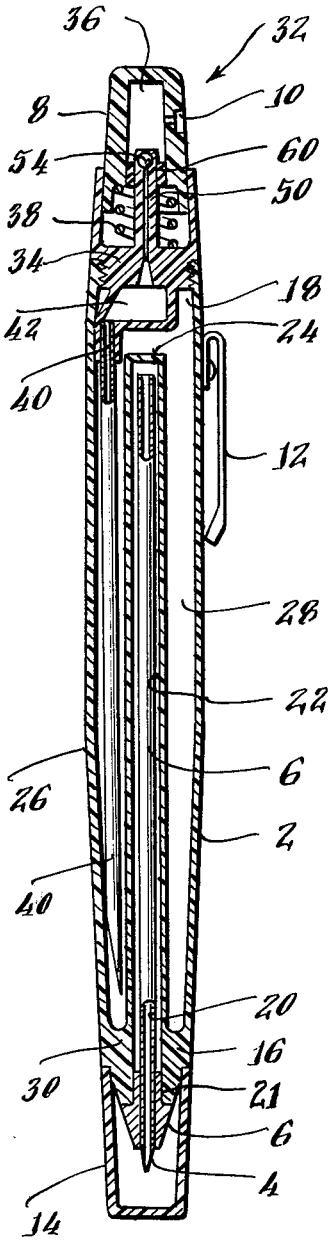
FIG. 2 is a cross-sectional view taken substantially along the line 2—2 of FIG. 1.

Referring now to FIG. 2, it is seen that the housing 2 has a closed end shown generally by numeral 16 and an open end shown generally by numeral 18. A recess 20, which accommodates the shaft of the writing implement 6, extends inwardly into the elongated housing from the closed end 16 thereof. A resilient collar 21 near the tip of the writing implement is approximately the same size as the recess 20 so as to secure the writing implement within the recess and also to provide for easy removal of the writing implement for replacement purposes.

The recess 20 is defined by a cylindrical wall 22 and a top closure 24. The elongated housing 2 has a cylindrical sidewall 26 which surrounds the wall 22 forming an annular chamber 28 between sidewalls 22 and 26. The chamber 28 is closed by a wall 30, thereby enabling the annular chamber to retain a liquid therein.

A pump shown generally by numeral 32 is mounted at the open end 18 of the elongated housing 2. The pump includes a base 34 fixed to the inside of the housing 2 and a plunger 8 movable relative to the base. The pump seals the open end of the chamber 28 but can be removed to allow replacement of liquid.

A hollow pump chamber 36 defined within the plunger 8 has an open end 37 facing inwardly into the elongated housing and a spray nozzle 10 is formed through the side of the plunger. The plunger is movably mounted relative to the fixed base for reciprocating movement with respect thereto. The open end of the plunger abuts against a compression spring 38. The plunger, which is intended to be depressed by the finger of a user, will thereby return to the position shown in FIG. 2 after any force on it is removed.

A tube 40 extends into chamber 28 and connects to a chamber 42 defined by base 34 of the pump to provide a passage for liquid from the annular chamber to the pump.

Figure 3:
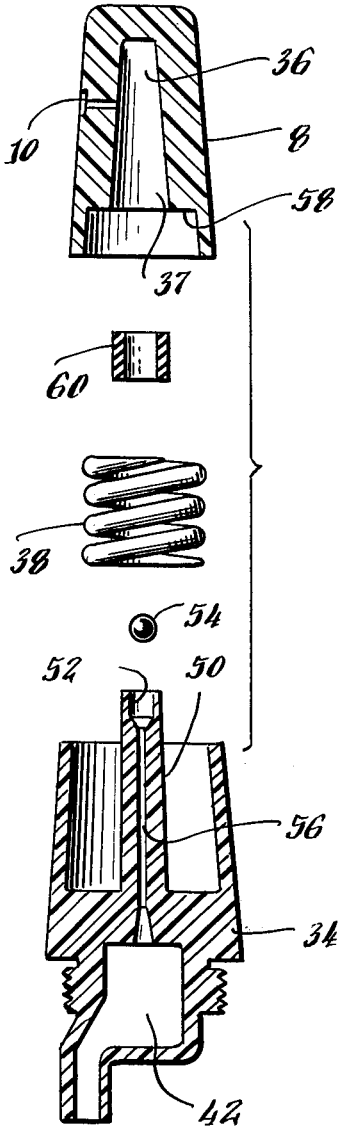
FIG. 3 is an exploded sectional view of the pump used in the instrument shown in FIG. 1.

The pump 32 is shown in greater detail in FIG. 3, to which reference is now made. The pump includes base 34 having a tube 50 extending in a direction towards the plunger 8. The tube terminates in a cup or seat 52 which is adapted to hold a ball bearing 54. Seat 52 and ball bearing 54 form a ball valve at the end of the tube 50. The open end of the cup 52 may be deformed to prevent the ball bearing 54 from escaping. The bore 56 of tube 50 extends through the base 34. Accordingly, the bore 56 provides a passageway from chamber 42 through the base 34 to the seat 52.

As already noted, the base 34 of the pump is fixed within one end of the elongated housing 2. It can be mounted therein in many ways known to the art as, for example, by threading. The base 34 is mounted so that tube 50 is in alignment with the pump chamber 36 formed in plunger 8. The compression spring 38 is interposed between the base 34 and the plunger 8 and is positioned around the tube 50. This spring abuts against the base 34 at one end and against the shoulder 58 of the plunger 8 at its other end. Accordingly, the plunger 8 is spring-biased away from the base 34 when no force is exerted on the plunger.

An annular elastomeric seal 60 is mounted tightly within chamber 36 and around the tube 50. The seal slides along tube 50 to seal the open end 37 of the pump chamber 36 when the plunger 8 is depressed.

Operation of the new dual function instrument will now be discussed with reference to FIGS. 1–3. When the instrument is used for writing, the cap 14 is removed from the end of the elongated housing 2 to expose the writing tip 4. As already mentioned, the writing implement 6 is removably retained within the recess 20. The end of the writing implement carries an annular collar 21 of approximately the same size as the recess so that the writing implement is frictionally retained within the recess yet can be readily removed for replacement.

The annular chamber 28 formed around the recess 20 is for storing a liquid to be dispensed as, for example, perfume, cologne or the like. The wall 30 closes the end of chamber 28. The annular chamber is filled by removing the pump structure 32 from the open end 18 of housing 2.

Assuming initially that there is no liquid but only air within the pump chamber 36, the plunger 8 is depressed by the finger of the user. As a result, the plunger moves towards the base 34 and the tube 50 is received within the hollow pump chamber 36. The tube substantially reduces the volume of the pump chamber, thereby increasing the air pressure within the chamber. As a result of the increased air pressure, ball bearing 54 is forced against the seat 52 at the end of the tube 50. Excess air is released through nozzle 10. The open end 37 of the pump chamber is sealed by the annular seal 60.

After air has been purged from the pump chamber as discussed above, the force on the plunger is removed and it is allowed to return to its initial position, spring-biased away from the base. Because the tube 50 no longer extends into the pump chamber 36, the effective volume of the pump chamber increases, thereby creating a decreased pressure within the pump chamber. This decreased pressure draws the ball bearing 54 from its seat 52. The decreased pressure also draws liquid from the annular chamber 28 through the connecting tube 40, into the chamber 42 at one end of the tube 40, through the bore 56 in the tube 50, and into the pump chamber 36. After the pump chamber is filled with liquid from the annular chamber, the pressure within the pump chamber is substantially equal to the pressure in the annular chamber 28, and the ball bearing 54 drops back onto its seat 52.

To dispense liquid through the spray nozzle, the plunger is depressed, as discussed above, so that the tube 50 enters the pump chamber, thereby increasing the liquid pressure in the pump chamber. The increased liquid pressure forces the ball against its seat to prevent backup of the liquid into chamber 28. When the liquid pressure within the pump chamber exceeds the flow resistance through the small diameter nozzle 10, liquid is expelled.

The plunger then returns to its original position, decreasing the pressure within the pump chamber which draws the ball from its seat and more liquid from the annular chamber 28. The instrument is now ready to commence another spray cycle and such cycles can be repeated until all of the liquid within the annular chamber has been depleted, at which time the liquid can be replaced by removing the pump from the end of the housing and replenishing the liquid through the open end of the elongated housing.

As discussed herein, a dual purpose instrument capable of functioning as a writing implement and as a liquid dispenser has been provided. The above description is intended to be illustrative only and not restrictive of the scope of the invention, that scope being defined by the following claim and all equivalents thereto.

What is claimed is:

1. An instrument for retaining a writing implement and for dispensing a liquid, said instrument comprising:

an elongated housing of a size and shape approximate to that of a pen or pencil, said elongated housing having a closed end and an open end;

said closed end of said elongated housing having an inner recess extending longitudinally into said housing towards said open end, said recess being shaped to removably receive a writing implement therein;

a liquid holding annular chamber defined between said elongated housing and said inner recess, closed at the closed end of said housing and open at the open end of said housing;

a pump mounted in the open end of said elongated housing and communicating with said annular chamber through said open end; and means for receiving and spraying liquid pumped by said pump from said annular chamber.

2. An instrument as claimed in claim 1 wherein said pump is mounted to the open end of said elongated housing in airtight sealing relationship therewith.

3. An instrument as claimed in claim 1 further including a tube having one end coupled to said pump and having its other end received within said annular chamber through the open end thereof so that said tube defines a passageway for liquid flow between said annular chamber and said pump.

4. An instrument as claimed in claim 1 wherein said liquid retained within said annular chamber is a perfume.

5. An instrument as claimed in claim 1 wherein said pump includes:

a base fixed within said elongated housing having a tube extending therefrom in the direction of the open end of said elongated housing, said base and tube defining a bore extending therethrough, said tube terminating in a ball valve at the end thereof, the end of the bore opposite said ball valve communicating with said annular chamber;

a plunger movably mounted in the open end of said elongated housing for reciprocating motion relative to said fixed base, said plunger having a hollow pump chamber defined therein, and a spray nozzle therethrough, said plunger being mounted in alignment with the tube extending from said base to receive it within the pump chamber when said plunger is moved towards said base;

wherein movement of said plunger towards said base decreases the volume of said pump chamber to effectively increase pressure within said chamber above a predetermined level, and movement of said plunger away from said shaft increases the volume of said pump to effectively decrease the pressure within the chamber, said ball valve cooperating to prevent flow of fluid through said bore in said shaft when the pressure in said pump chamber is increased and allowing flow of liquid from said annular chamber through said bore and into said pump chamber when the pressure therein is decreased.

6. An instrument as claimed in claim 5 further including a tube interposed between said bore in said base and said annular chamber for providing a passageway for liquid flow therebetween.

7. An instrument as claimed in claim 5 further including a compression spring positioned around said tube, one end of said compression spring abutting agsinst said base and the other end of said compression spring abutting against said plunger so that said plunger is movable towards said base but spring biased away from said base.

8. An instrument as claimed in claim 7 wherein an annular seal is mounted around said tube and interposed between said tube and said compression spring, said annular seal having a sufficient thickness to seal the open end of said pump chamber in said plunger when said plunger is depressed and said tube is received within said pump chamber.

9. An instrument as claimed in claim 5 wherein said spray means includes a valve on said plunger which permits fluid to flow out of said pump chamber only when the fluid pressure within said pump chamber exceeds said predetermined level.

10. An instrument as claimed in claim 5 wherein said base and said plunger are removably mounted to said elongated housing so that said base and said plunger can be removed from said open end of said housing to enable replenishment of the liquid in said annular chamber.

11. An instrument as claimed in claim 10 wherein the outer surface of said base and a portion of the inner surface of said elongated housing are complementary threaded so that said base is mounted within said elongated housing by threading.

12. An instrument as claimed in claim 5 wherein the liquid retained in said annular chamber is a perfume.

* * * * *